US005079788A

United States Patent [19]

Raupp

[11] Patent Number: 5,079,788

[45] Date of Patent: Jan. 14, 1992

[54] CUSHIONED CONTOURED BEDPAN

[76] Inventor: Annette Raupp, 1358 Cottonwood, Crystal Lake, Ill. 60014

[21] Appl. No.: 527,108

[22] Filed: May 22, 1990

[51] Int. Cl.[5] ..... A61G 9/00

[52] U.S. Cl. ..... 4/450; 4/456

[58] Field of Search ..... 4/450, 456, 457, 451, 4/452, 453, 454, 455; 24/56, 57; 128/760, 761, 767

[56] References Cited

U.S. PATENT DOCUMENTS

| | | | |
|---|---|---|---|
| D. 270,018 | 8/1983 | Knight | D24/57 |
| 760,229 | 5/1904 | Meinecke et al. | 4/450 |
| 3,084,348 | 4/1963 | Parker et al. | 4/456 |
| 3,597,771 | 8/1971 | Rickmeier | 4/450 |
| 3,939,502 | 2/1976 | Miller | 4/456 |
| 4,368,548 | 1/1983 | Glass | 4/450 |

*Primary Examiner*—Renee S. Luebke
*Assistant Examiner*—David J. Walczak
*Attorney, Agent, or Firm*—Mason, Kolehmainen, Rathburn & Wyss

[57] ABSTRACT

A bedpan which provides ease of use through its low lying configuration while also minimizing pain typically associated with pan usage by providing contoured, padded surfaces that complement the user's body contour.

11 Claims, 2 Drawing Sheets

CUSHIONED CONTOURED BEDPAN

BACKGROUND OF THE INVENTION

1. Field of the Invention

The invention relates to a padded bedpan and particularly to contoured padded bedpans.

2. Background Information

Care must be taken to provide bed-ridden patients with easy to use methods and procedures for disposing of urine and feces. This need is particularly acute when dealing with patients suffering from extreme pain due to healing fractures or other ailments, and when dealing with elderly patients who suffer from bed sores and who are less nimble and more brittle than other patients.

While the bedpan is far from a revolutionary concept, the idea of providing a comfortable appliance continues to fall short in the practiced art. Some pan designs (U.S. Pat. No. 3,084,348) reflect the importance of minimizing patient jostling by incorporating a low lying, wedge-like shape. Other designs (U.S. Pat. Nos. 870,984, 2,730,725 and 4,368,548) incorporate large volume and anti-tipping configurations. Nevertheless, a single appliance incorporating these and other features remains elusive.

Furthermore, nothing in the prior art has taught a design that has a relatively small "footprint" on fewer of the patient's bearing surfaces, nor have current appliances taught novel ways to increase pan volume while also maintaining a sleek and low profile.

SUMMARY OF THE INVENTION

It is an object of the present invention to provide a bedpan which overcomes the problems associated with the prior art.

It is another object of the present invention to provide a bedpan.

Still another object of the present invention is to provide a bedpan with a series of contoured, padded surfaces.

An additional object of the present invention is to provide a bedpan designed to eliminate or greatly minimize the discomfort and inconvenience associated with usage of such an appliance by providing for a unique body-contoured surface.

Briefly, the present invention relates to a bedpan for providing ease of use through its low lying configuration while also minimizing pain typically associated with pan usage by providing contoured, padded

DESCRIPTION OF THE DRAWINGS

These and other objects and advantages of the present invention will be apparent from the following description and accompanying drawing, wherein.

DETAILED DESCRIPTION

Figure 1:
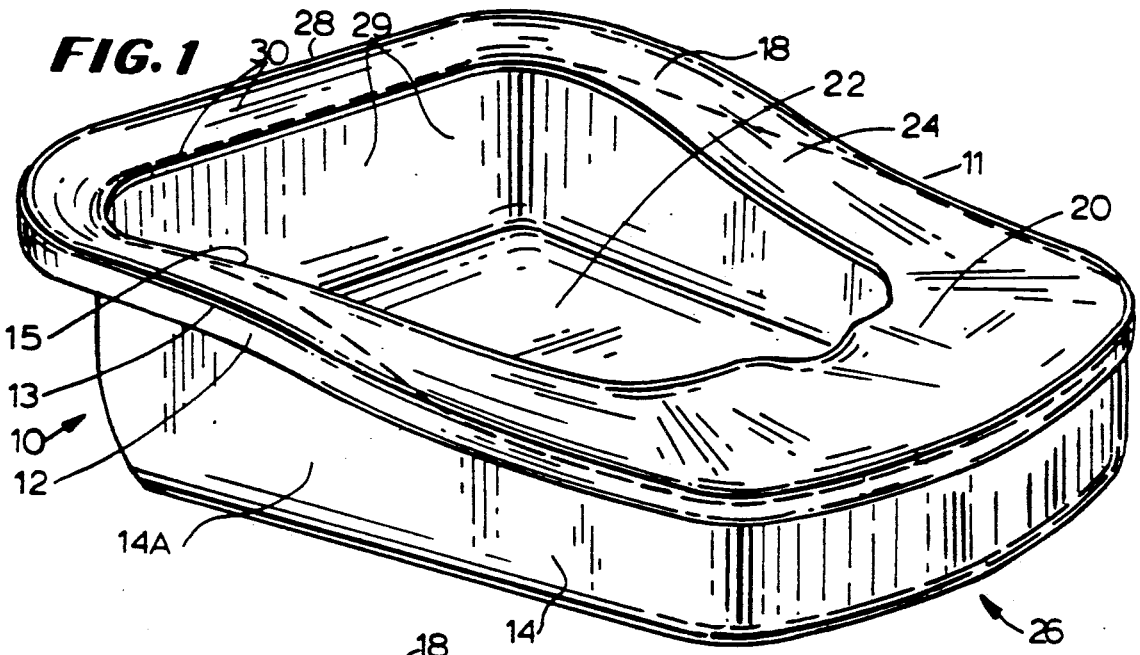
FIG. 1 is a perspective view of a bedpan in accordance with the present invention.
Figure 2:
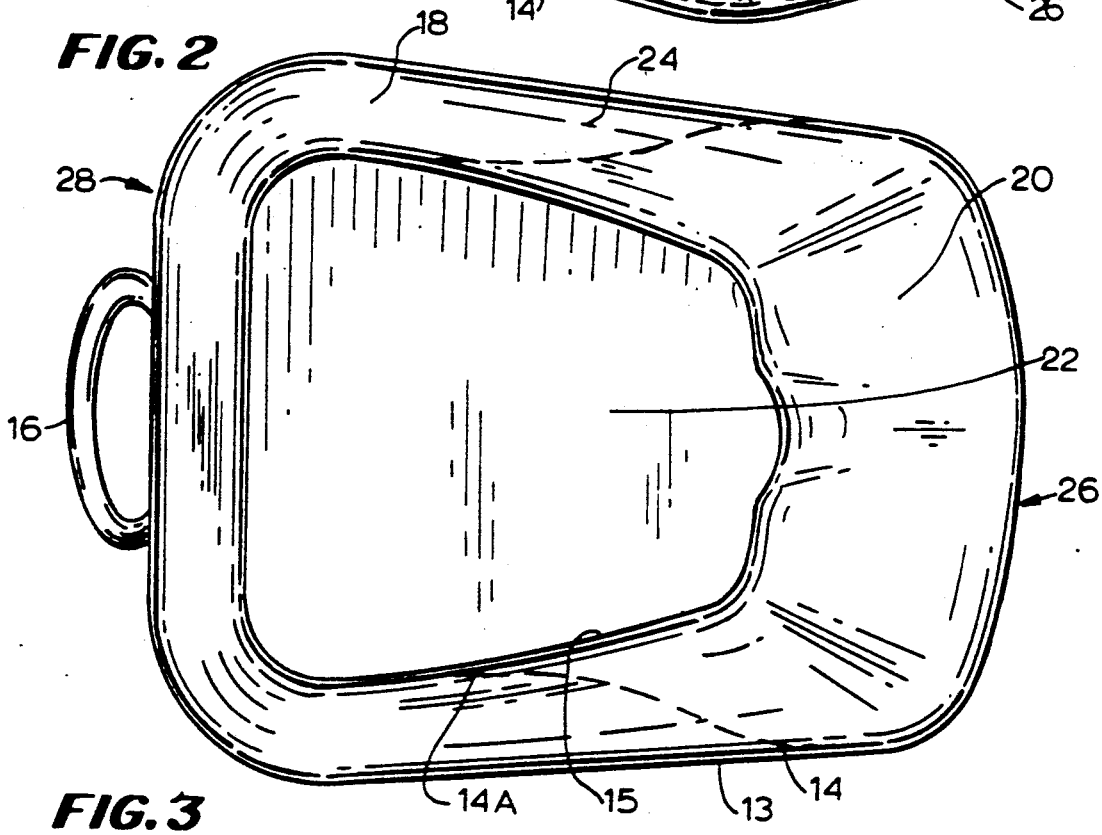
FIG. 2 is a top view of the bedpan according to the present invention.
Figure 3:
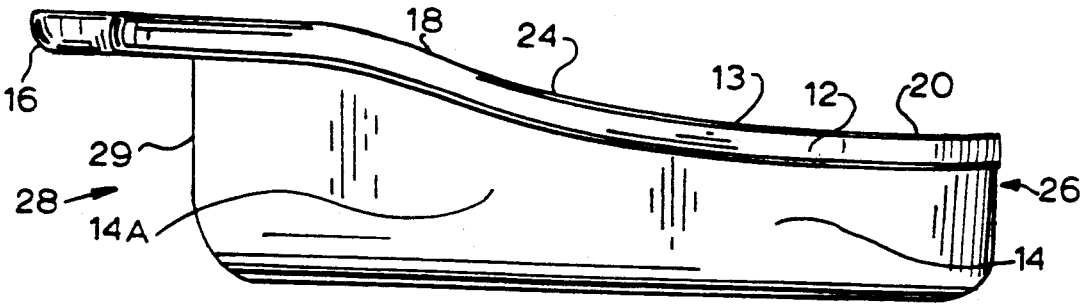
FIG. 3 is a side elevational view of the bedpan in accordance with the present invention.
Figure 4:
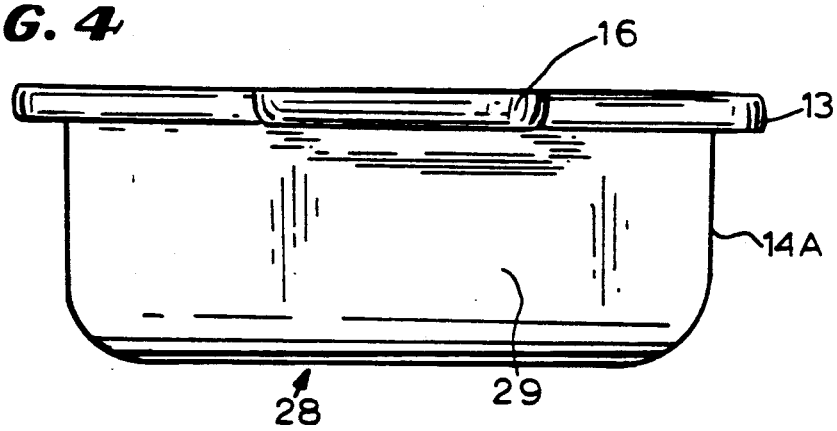
FIG. 4 is a rear elevational view of the bedpan.
Figure 5:
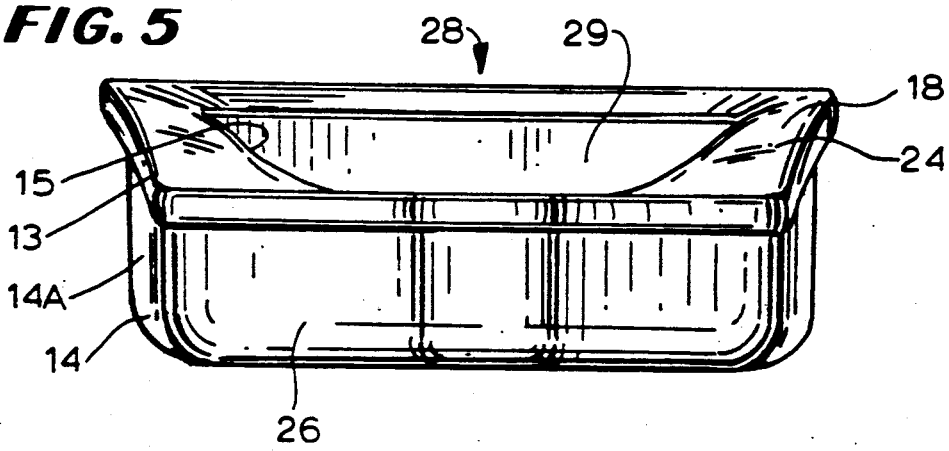
FIG. 5 is a front elevational view of the bedpan.

The bedpan according to the invention, generally designated by the reference numeral 10, facilitates the excretion and disposal of urine and feces from bedridden persons. A salient feature of the bedpan 10 is its small "fingerprint" on the user's body surface. This fingerprint is defined by a top surface 11 containing an opening into a cavity designed to receive and contain bodily waste. Contrary to conventional bedpan configurations, where the buttocks-end of the pan typically is wider than the attendant end, the configuration of the instant invention is reversed. Specifically, the instant bedpan 10 effects a truncated pie-slice configuration whereby the width of the opening adjacent to the buttocks-supporting region 20 of the top surface 11 is narrower than the opening adjacent and between a pair of thigh-bearing surfaces 18 of the top surface 11 and is also narrower than the width of the opening adjacent the attendant end 28 of the bedpan 10 by at least one third. The preferred dimensions of the opening are 5 inches wide at the buttocks-supporting region 20 and 8 inches wide at the attendant end 28 of the bedpan 10. The preferred dimensions of the top surface 11 of the bedpan 10 are 9 inches wide at the buttocks supporting region 20 and 11 inches wide at the attendant end 28 of the bedpan 10. This v-shape design helps to minimize the number of pressure points between the user and the appliance and therefore significantly reduces pain.

The preferred overall length of the bedpan 10 is 13 inches, which is the approximate distance from the buttocks to the middle of the thigh. This support length helps to facilitate support of the lower body from the buttocks to the less pressure-sensitive middle thigh. The preferred length of the opening of the bedpan 10 from the buttocks-supporting surface 20 to the attendant side 28 of the bedpan 10 is 8 inches.

The bedpan's 10 low lying configuration, as illustrated in FIG. 1, allows the user to merely slide his or her thighs over the buttocks supporting region 20 to rest them on the thigh-supporting surfaces 18. A relatively shallow region 26 directly beneath the buttocks-supporting region 20 permits maneuverability and less lifting by the patient. The increased height of the bedpan 10 at the thigh-supporting surface 18 and the sloping region 24 running from the buttocks supporting region 20 to the thigh supporting region 18 accommodates the natural tendency for the legs to remain slightly elevated and slanted when the lower back is raised. A preferred height for the buttocks end 26 of the pan 10 from its base 22 to the buttocks supporting region 20 is 2.5 inches while the height at the opposite end or attendant side 28 of the pan 10 is 4 inches. The usable depth of the bedpan 10 at the buttock's supporting region 20 is preferably 2 inches while the usable depth at the attendant end 28 of the bedpan 10 is 2.5 inches.

The top surface 11 of the bedpan 10 is defined as a contoured bearing surface which complements the user's body surface. One end of the top surface 11 is a generally flat, plateau-like area for the buttocks. The preferred width from the inside edge 15 to the outer edge 13 of the top surface 11 defining the buttocks-supporting region 20 is 4 inches. Toward the middle of the bedpan 10, the surface imparts a sloping region 24 which helps to accommodate the natural tendency of the user's thighs to project upward when the lower back is raised. At the attendant end 28 of the bedpan 10, the surface 11 defines a second plateau as the thigh-supporting surface 18. At the attendant side 28 of the bedpan 10, the width of the top surface 11 from its inside edge 15 to the outside edge 13 is one and a half inches. This width is considerably less than the 4 inch width of the buttocks-supporting region 20 as the possibility of indentation or "rimming" and pain is much reduced due to less weight being exerted on the thighs while the user is in a supine position.

The top surface 11 of the pan 10 can be comprised of either rigid or nonrigid materials. Preferably, the various sloping and flat regions of the top surface 11 mentioned above are integrally connected to each other in the form of a nonrigid, liquid-impermeable pad 12 which can be easily disinfected by conventional means. The preferable thickness of the pad 12 is threequarters of an inch. This pad may be removable. At the buttocks end 26 of the bedpan 10 and along the plateau-like area 20 for the buttocks, the pad 12 curves over the outer edges 13 of the bedpan's 10 top surface 11 so as to prevent "rimming" to the user and allow for a longer dwell time on the appliance.

Figure 6:
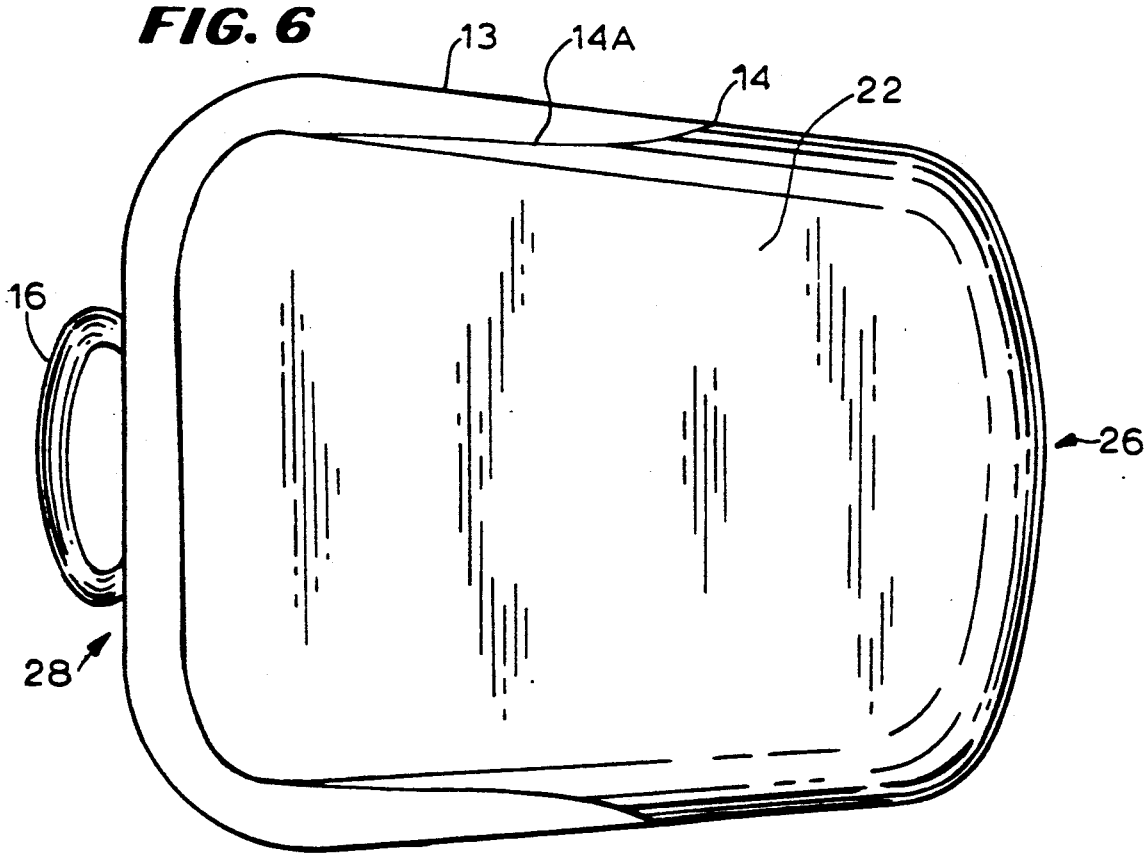
FIG. 6 is a bottom view of the bedpan.

A concern among tertiary care personnel is the need for smooth, continuous surfaces of bedpan interiors so as to facilitate trouble-free emptying and cleaning of the bedpan 10. As depicted in FIG. 6, at approximately the middle of the sloping region 24 of the pan 10, the sides 14 deviate inwardly toward the longitudinal axis of the pan, resulting in a substantial overhang of the outer edge 13 of the top surface 11 over the walls 14 supporting the thigh-supporting surfaces 18. The deviation of the sides 14 continues to the point where the inside edge 15 of the top surface 11 is flush with the back wall 29 and second half 14A of the side walls 14 of the bedpan 10, thereby allowing for easy evacuation of the bedpan's 10 contents. Another depiction of the deviation of the pan sides 14 can be noted as dashed lines in FIG. 1. The overhang of the top surface 11 near the thigh-bearing surfaces 18 and at the attendant side 28 of the bedpan 10 are also depicted in FIG. 6. At the juncture where deviation of the sides 14 begin, the width of the top surface 11 from its inside edge 15 to the outside edge 13 is 2 inches.

To further facilitate thorough cleaning, the sides 14 of the bedpan 10 are integrally joined to the base 22 of the pan 10 in a curvilinear fashion rather than in an abrupt 90-degree angle so that hard to reach, and therefore hard to clean, niches are avoided. Also, while not absolutely necessary, a handle 16 can be attached at the attendant end 28 of the pan 10 for easy pan 10 removal.

The bedpan 10 can be constructed of any suitable liquid-impermeable material, such as plastic. The top surface 11, walls 14 and base 22 of the pan 10 can be constructed of a rigid substance, whereas the pad 12 can be constructed of a pliable, nonrigid, liquid-impermeable substance, such as plastic. The pad 12 can be permanently attached with any suitable adhesive or removably attached with any other mechanical fastener, such as snaps, velcro-type fasteners, or the like. Also, if the padded support feature is not desired, the entire pan 10 may be fabricated from the same material with the top surface 11 being either integrally formed with the pan 10 or separately formed.

Obviously, many modifications and variations of the invention as hereinbefore set forth can be made without departing from the spirit and scope thereof, and, therefore, only such limitations should be imposed as are indicated by the appended claims.

What is claimed and sought to be secured by Letters Patent is:

1. A bedpan to permit a user to dispose of bodily waste, comprising:

a base having a flat bottom surface and a bodily waste cavity contained within said base; and means for supporting a user over said wste cavity to permit the patient to discharge bodily waste into said waste cavity, said user supporting means including a flat buttocks supporting member which is parallel with said bottom surface disposed at one end of said bedpan and a pair of thigh supporting members extending from said buttocks supporting member along the sides of the bedpan toward an attendant end opposite said buttocks supporting end; wherein said thigh supporting members diverge and increase in height and become flat and parallel with said bottom surface as they approach the attendant end of the bedpan.

2. A bedpan as recited in claim 1 whereby the means for supporting the patient has an inner edge defining an opening into said cavity, such that the opening is narrower at the said buttocks supporting member than at the said attendant end, and the attendant end of the bedpan is wider than the buttocks supporting member.

3. A bedpan as recited in claim 2 wherein the said opening at the said buttocks supporting member is at lest one third narrower than said opening at said attendant end.

4. A bedpan as recited in claim 1 wherein said buttocks supporting member and said thigh supporting members are integrally connected to form a top surface.

5. A bedpan as recited in claim 4 wherein said top surface is contoured to complement the user's buttocks and upper thighs.

6. A bedpan as recited in claim 4 wherein said top surface comprises a nonrigid, liquid impermeable pad.

7. A bedpan as recited in claim 6 wherein said nonrigid, liquid impermeable pad is comprises of plastic.

8. A bedpan as recited in claim 1 wherein said base is comprised of a bottom wall having peripheral edges and upright walls attached to said peripheral edges so as to support said user supporting means.

9. A bedpan as recited in claim 8 wherein said patient supporting means has an outer peripheral edge, said peripheral edge overhanging said upright walls along the said sides and said attendant end of the bedpan.

10. A bedpan as recited in claim 8 wherein said base, upright walls and top surface are comprised of a rigid, liquid impermeable material.

11. A bedpan as recited in claim 10 wherein said base, upright walls and top surface are comprised of plastic.

* * * * *